United States Patent [19]

Van Allan et al.

[11] 4,394,428

[45] Jul. 19, 1983

[54] PHOTOCONDUCTIVE COMPOSITION AND ELEMENTS COMPRISING TWO DIFFERENT COMPOUNDS HAVING A DIOXABORIN NUCLEAS ON A DERIVATIVE THEREOF

[75] Inventors: James A. Van Allan; Jerome H. Perlstein; George A. Reynolds; Thomas E. Goliber, all of Rochester, N.Y.

[73] Assignee: Eastman Kodak Company, Rochester, N.Y.

[21] Appl. No.: 305,257

[22] Filed: Sep. 24, 1981

[51] Int. Cl.[3] ..... G03G 5/09

[52] U.S. Cl. ..... 430/83; 430/900

[58] Field of Search ..... 430/83, 900

[56] References Cited

U.S. PATENT DOCUMENTS 3,567,439 3/1971 Daniel et al. .

4,123,268 10/1978 Halm .

4,152,152 5/1979 Conteis et al. ..... 430/83

*Primary Examiner*—John E. Kittle

*Assistant Examiner*—John L. Goodrow

*Attorney, Agent, or Firm*—John R. Everett

[57] ABSTRACT

Photoconductive compositions having improved quantum efficiency are disclosed. The compositions comprise:

(a) an electron donating photoconductor; and sensitizing amounts of (b) a first electron acceptor selected from cyanine and styryl methine dyes having a 1,3,2-dioxaborin nucleus and (c) a second electron acceptor selected from methine-free compounds having a nucleus selected from the group consisting of 1,3,2-dioxaborin; 1,3,2-oxazoborin and 1,3,2-diazoborins.

5 Claims, No Drawings

PHOTOCONDUCTIVE COMPOSITION AND ELEMENTS COMPRISING TWO DIFFERENT COMPOUNDS HAVING A DIOXABORIN NUCLEAS ON A DERIVATIVE THEREOF

FIELD OF THE INVENTION

This invention relates to photoconductive compositions and elements having improved quantum efficiency and photosensitivity to a wide range of the visible spectrum.

BACKGROUND OF THE INVENTION

Electrophotographic imaging processes and techniques have been extensively described in the prior art. Generally, such processes have in common the step of imagewise exposing a photoconductive element to electromagnetic radiation to which the element is sensitive, thereby forming a latent electrostatic charge image. A variety of subsequent operations, well known in the art, are then employed to produce a permanent record of the image.

Daniel et al in U.S. Pat. No. 3,567,439 discloses cyanine and styryl dyes containing 1,3,2-dioxaborinium salt moieties which are useful as spectral sensitizers for organic photoconductors of the triarylmethane type.

Halm in U.S. Pat. No. 4,123,268 describes similar boron diketonate chelates which lack the methine group of the cyanine and styryl dyes cited above. These boron diketonate chelates when blended with certain polyvinylcarbazole polymers or with triphenylamine produce photoconductive coatings of high electrophotographic sensitivity in the ultraviolet region of the spectrum.

The boron diketonate-sensitized photoconductive compositions described by Halm are severely range-limited in spectral response. The cyanine and styryl boron dyes described by Daniel et al show a broad spectral response but are not as effective in increasing the quantum efficiency of photoconductive compositions.

SUMMARY OF THE INVENTION

We have found, unexpectedly, that a photoconductive composition comprising:

(a) an electron donating photoconductor; and sensitizing amounts of (b) a first electron acceptor selected from cyanine and styryl methine dyes having a 1,3,2-dioxaborin nucleus and (c) a second electron acceptor selected from methine-free compounds having a nucleus selected from the group consisting of 1,3,2-dioxaborin; 1,3,2-oxazaborin and 1,3,2-diazoborins enhances quantum efficiency over a wide range of the visible spectrum compared to compositions that contain the electron donating photoconductor and either electron acceptor alone.

In a preferred embodiment the photoconductive compositions comprise (a) a triarylamine electron donor and sensitizing amounts of (b) a first electron acceptor having a structure selected from the group consisting of:

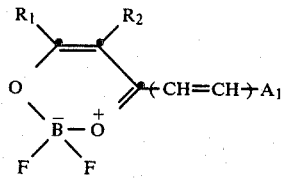

(I)

and

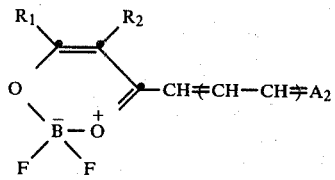

(II)

wherein:

$R_1$ and $R_2$ each independently represents hydrogen, alkyl, aryl or taken together with the carbon atom to which they are attached form a fused mono- or polynucleus carbocyclic group having 6 to 10 carbon atoms or a fused heterocyclic group such as pyran-4-one or thiopyran-4-one or a heterocycle such as thiophene and furane;

$A_1$ represents aminoaryl, aryl, alkylamino or julolylidine;

$A_2$ represents a substituted or unsubstituted nitrogen-containing heterocyclic nucleus of the type used in styryl and cyanine methine dyes; and (c) a second electron acceptor selected from the group consisting of:

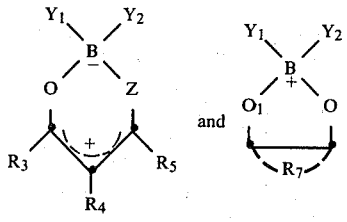

wherein:

$R_3$, $R_4$ and $R_5$ each independently represents hydrogen, alkyl, aryl, furyl, thienyl, alkoxy, hydroxy or trihaloalkyl; or $R_3$ and $R_4$ or $R_4$ and $R_5$, taken together with the carbon atoms to which they are attached, form fused thiopyran or a mono- or polynucleus carbocyclic group having 6 to 10 carbon atoms;

$R_7$ represents the atoms necessary to form a member selected from the group consisting of pyran, thiopyran and benzopyran;

$Y_1$ and $Y_2$ represent fluoro or $Y_1$ and $Y_2$ taken together with B form a 1,3,2-dioxoborin nucleus;

Z represents O, and

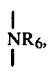

in which $R_6$ represents aryl or $R_6$ together with

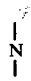

represents a fused benzothiazolene nucleus.

The alkyl groups are straight or branched chain and have from 1–10 carbon atoms. Aryl, as a prefix or a suffix, is substituted or unsubstituted such as phenyl or naphthyl. Substituents on aryl include hydroxy, alkyl, halogen, alkoxy, amino, substituted amino and nitro.

We have found that the enhanced quantum efficiency and photosensitivity occur close to the wavelength of maximum absorption of the first electron acceptor in the visible region of the spectrum. This is entirely unexpected since the second electron acceptor does not absorb in the visible region of the spectrum.

DETAILED DESCRIPTION OF THE INVENTION

The various components of the photoconductive compositions of the present case, method for making the components, the compositions and elements are described in detail below.

The cyanine and styryl methine dyes having a 1,3,2-dioxaborin nucleus used as the first electron acceptors in this invention are made according to the procedures described in J. A. VanAllan and G. A. Reynolds, *Journal of Heterocyclic Chemistry,* Vol. 6, p. 29 (1969).

$A_2$ represents a substituted or unsubstituted nitrogen-containing heterocyclic nucleus of the type used in styryl and cyanine dyes. Representative examples of such nuclei include:

(a) an imidazole nucleus such as imidazole and 4-phenylimidazole;

(b) a 3H-indole nucleus such as 3H-indole, 3,3-dimethyl-3H-indole and 3,3,5-trimethyl-3H-indole;

(c) a thiazole nucleus such as thiazole, 4-methylthiazole, 4-phenylthiazole, 5-methylthiazole, 5-phenylthiazole, 4,5-dimethylthiazole, 4,5-diphenylthiazole and 4-(2-thienyl)thiazole;

(d) a benzothiazole nucleus such as benzothiazole, 4-chlorobenzothiazole, 5-chlorobenzothiazole, 6-chlorobenzothiazole, 7-chlorobenzothiazole, 4-methylbenzothiazole, 5-methylbenzothiazole, 6-methylbenzothiazole, 5-bromobenzothiazole, 6-bromobenzothiazole, 4-phenylbenzothiazole, 5-phenylbenzothiazole, 4-methoxybenzothiazole, 5-methoxybenzothiazole, 6-methoxybenzothiazole, 5-iodobenzothiazole, 6-iodobenzothiazole, 4-ethoxybenzothiazole, 5-ethoxybenzothiazole, tetrahydrobenzothiazole, 5,6-dimethoxybenzothiazole, 5,6-dioxymethylenebenzothiazole, 5-hydroxybenzothiazole and 6-hydroxybenzothiazole;

(e) a naphthothiazole nucleus such as naphtho[1,2-d]thiazole, naphtho[2,1-d]thiazole, naphtho[2,3-d]thiazole, 5-methoxynaphtho[2,1-d]thiazole, 5-ethoxynaphtho[2,1-d]thiazole, 8-methoxynaphtho[1,2-d]thiazole and 7-methoxynaphtho[1,2-d]thiazole;

(f) a thianaphtheno-7′,6′,4,5-thiazole nucleus such as 4′-methoxythianaphtheno-7′,6′,4,5-thiazole;

(g) an oxazole nucleus such as 4-methyloxazole, 5-methyloxazole, 4-phenyloxazole, 4,5-diphenyloxazole, 4-ethyloxazole, 4,5-dimethyloxazole and 5-phenyloxazole;

(h) a naphthoxazole nucleus such as naphth[1,2-d]oxazole and naphth[2,1-d]oxazole;

(i) a selenazole nucleus such as 4-methylselenazole and 4-phenylselenazole;

(j) a benzoselenazole nucleus such as benzoselenazole, 5-chlorobenzoselenazole, 5-methoxybenzoselenazole, 5-hydroxybenzoselenazole and tetrahydrobenzoselenazole;

(k) a naphthoselenazole nucleus such as naphtho[1,2-d]selenazole and naphtho[2,1-d]selenazole;

(l) a thiazoline nucleus such as thiazoline and 4-methylthiazoline;

(m) a 2-quinoline nucleus such as quinoline, 3-methylquinoline 5-methylquinoline, 7-methylquinoline, 8-methylquinoline, 6-chloroquinoline, 8-chloroquinoline, 6-methoxyquinoline, 6-ethoxyquinoline, 6-hydroxyquinoline and 8-hydroxyquinoline;

(n) a 4-quinoline nucleus such as quinoline, 6-methoxyquinoline, 7-methylquinoline and 8-methylquinoline;

(o) a 1-isoquinoline nucleus such as isoquinoline and 3,4-dihydroisoquinoline;

(p) a benzimidazole nucleus such as 1-ethylbenzimidazole and 1-phenylbenzimidazole;

(q) a 2-pyridine nucleus such as pyridine and 5-methylpyridine;

(r) a 4-pyridine nucleus;

(s) a thiazoline nucleus;

(t) benzoxazole;

(u) acridine;

(v) imidazoquinoxaline;

(w) imidazoquinoline; and (x) thiazoloquinoline.

Representative dyes useful as the first electron acceptor are disclosed in Table II of the examples.

The methine-free dyes having a 1,3,2-dioxaborin; 1,3,2-oxazoborin or 1,3,2-diazoborins nucleus used as the second electron acceptor are made according to a wide variety of chemical procedures, including those disclosed in the aforementioned U.S. Pat. No. 4,123,268. Representative methine-free dyes useful as the second electron acceptor are disclosed in Table I. In the table, the symbol "$\Phi_o$" represents phenyl.

TABLE I (Second Electron Acceptors)

| | | |
|---|---|---|
| (1) | 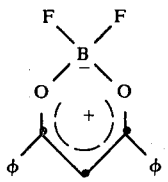 | (1,3-diphenyl-1,3-propanedioato-O,O′)difluoroboron |

TABLE I-continued (Second Electron Acceptors)

| | | |
|---|---|---|
| (2) | 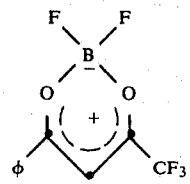 | (1-trifluoromethyl-3-phenyl-1,3-propanedioato-O,O')difluoroboron |
| (3) | 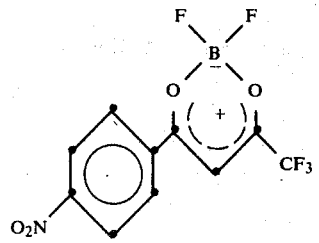 | [1-trifluoromethyl-3-(4-nitrophenyl)-1,3-propanedioato-O,O']-difluoroboron |
| (4) | 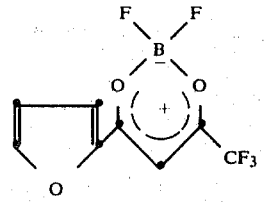 | [1-(2-furyl)-3-trifluoromethyl-1,3-propanedioato-O,O']difluoroboron |
| (5) | 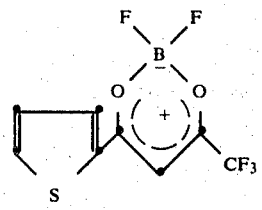 | [1-(2-thienyl)-3-trifluoromethyl-1,3-propanedioato-O,O']-difluoroboron |
| (6) | 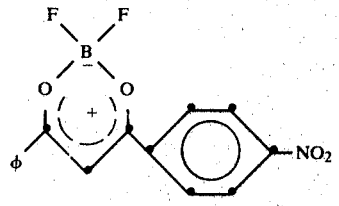 | [1-(4-nitrophenyl)-3-phenyl-1,3-propanedioato-O,O']difluoroboron |
| (7) | 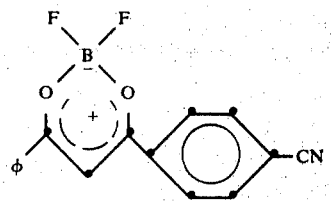 | [1-(4-cyanophenyl)-3-phenyl-1,3-propanedioato-O,O']difluoroboron |
| (8) | 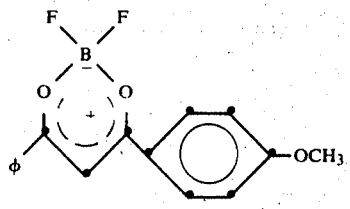 | [1-(4-methoxyphenyl)-3-phenyl-1,3-propanedioato-O,O']difluoroboron |

TABLE I-continued (Second Electron Acceptors)

(9) (4-phenylnaphtho[2,1-C]-1,3-propanedioato-O,O')difluoroboron

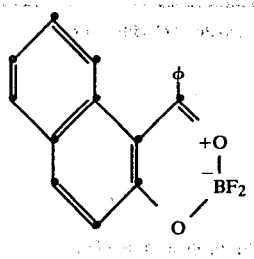

(10) (4-methylnaphtho[2,1-C]-1,3-propanedioato-O,O')difluoroboron

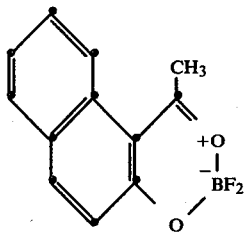

(11) [benzo[d]benzothiazolo[1,2-b]-1,3-propanazoato-N,O]difluoroboron

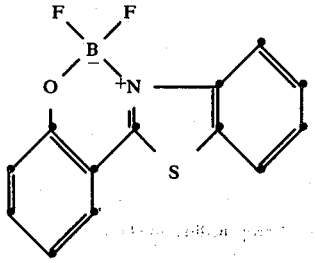

(12) [naphtho[2,1-d]benzothiazolo[1,2-b]-1,3-propanazoato-N,O]-difluoroboron

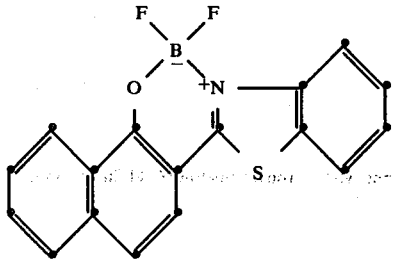

(13) (cyclohepta-2,4,6-trieno[1,2-c]ethanedioato-O,O')difluoroboron

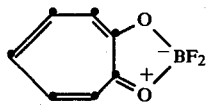

(14) (4,6-diphenyl-4H-thiapyrano[3,4-c]ethanedioato-O,O')difluoroboron

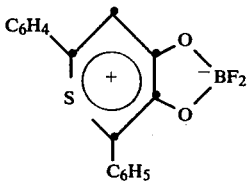

(15) (4-phenyl-4H-flaveno[3,4-c]ethanedioato-O,O')difluoroboron

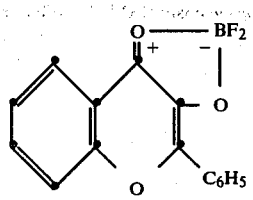

TABLE I-continued (Second Electron Acceptors)

| | | |
|---|---|---|
| (16) | 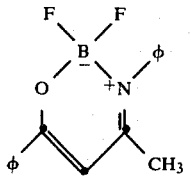 | (6-methyl-1,4-diphenyl-1,3-propaneazoato-N,O)difluoroboron |
| (17) | 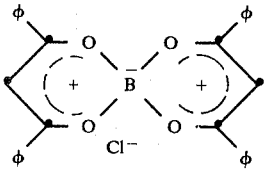 | bis(1,3-diphenyl-1,3-propanedioato-O,O')boron chloride |
| (18) | 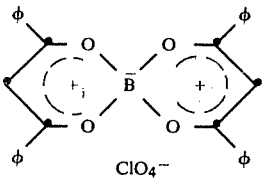 | bis(1,3-diphenyl-1,3-propanedioato-O,O')boron perchlorate |
| (19) | 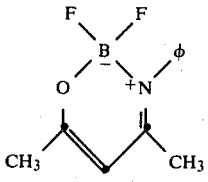 | (4,6-dimethyl-1-phenyl-1,3-propaneazoato-N,O)difluoroboron |
| (20) | 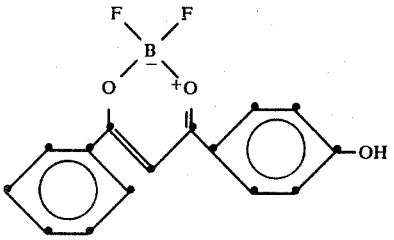 | [1-(4-hydroxyphenyl)-3-phenyl-1,3-propanedioato-O,O']-difluoroboron |
| (21) | 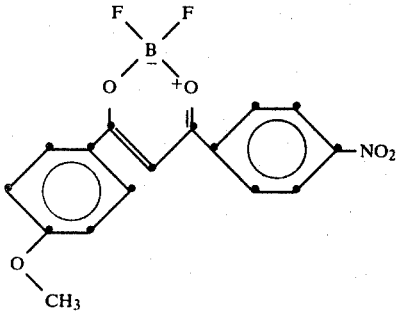 | [1-(4-methoxyphenyl)-3-(4-nitrophenyl)-1,3-propanedioato-O,O']difluoroboron |
| (22) | 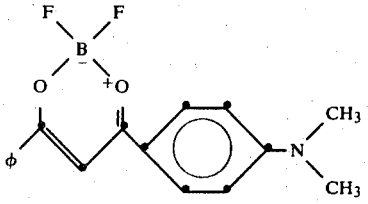 | [1-(4-dimethylaminophenyl)-3-phenyl-1,3-propanedioato-O,O']difluoroboron |

TABLE I-continued
(Second Electron Acceptors)
| | | |
|---|---|---|
| (23) | 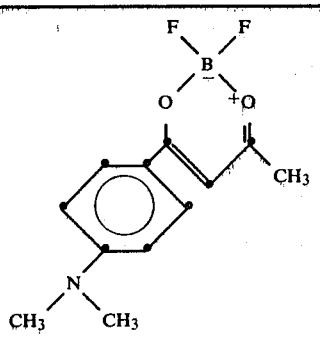 | [1-(4-dimethylaminophenyl)-3-methyl-1,3-propanedioato-O,O']difluoroboron |
| (24) | 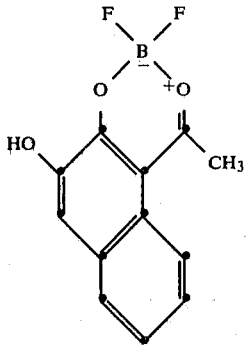 | (1-methyl-5-hydroxynaphtho[2,1-d]-1,3-propanedioato-O,O')difluoroboron |
| (25) | 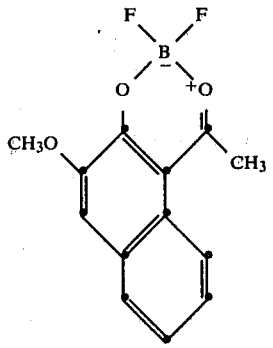 | (1-methyl-5-methoxynaphtho[2,1-d]-1,3-propanedioato-O,O')difluoroboron |
| (26) | 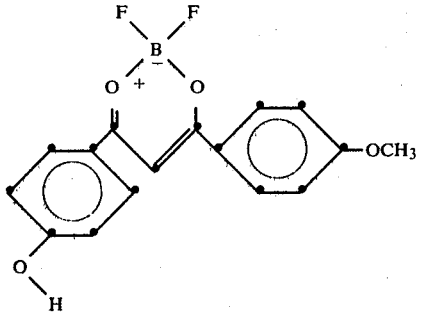 | [1-(4-hydroxyphenyl)-3-(4-methoxyphenyl)-1,3-propanedioato-O,O']difluoroboron |
| (27) | 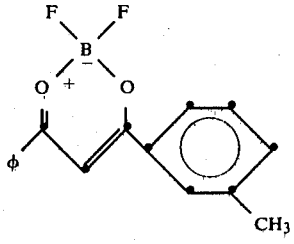 | [1-(3-methylphenyl)-3-phenyl-1,3-propanedioato-O,O']difluoroboron |

TABLE I-continued (Second Electron Acceptors)

| | | |
|---|---|---|
| (28) | 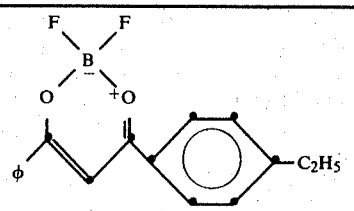 | [1-(4-ethylphenyl)-3-phenyl-1,3-propanedioato-O,O']difluoroboron |
| (29) | 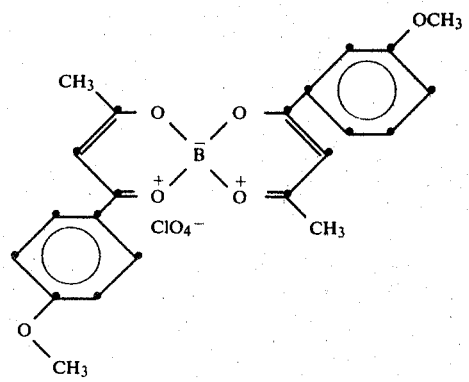 | bis[1-(4-methoxyphenyl)-3-methyl-1,3-propanedioato-O,O']boron perchlorate |
| (30) | 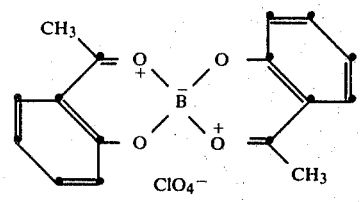 | bis(1-methyl-benzo[c]-1,3-propanedioato-O,O')boron perchlorate |
| (31) | 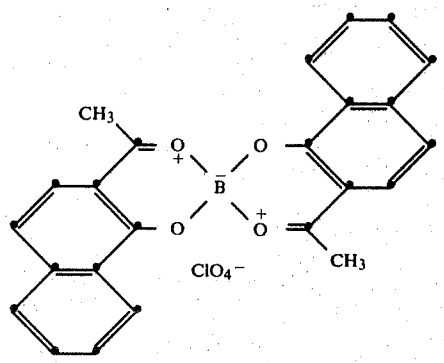 | bis(1-methyl-naphtho[1,2-c]-1,3-propanedioato-O,O')boron perchlorate |

Useful electron donors include materials designated as p type organic photoconductors in the patent literature, such as those disclosed in U.S. Pat. Nos. 3,615,414; 3,873,311; 3,873,312; 4,111,693; and *Research Disclosure* 10938, Volume 109, May 1973. These disclosures are expressly incorporated herein by reference. Especially useful electron donors are compounds which are triaryl amines or include a triarylamine component, such as tri-p-tolylamine and (di-p-tolylaminophenyl)cyclohexane. Polymeric organic photoconductors, such as polyvinylcarbazole, are also useful.

In general, the electron donor organic photoconductors are present in the composition in an amount equal to at least about 1 weight percent of the coating composition on a dry basis. The upper limit in the amount of electron donor substance present can be widely varied in accordance with usual practice. It is preferred that the electron donor be present, on a dry basis, in an amount of from about 1 weight percent of the coating composition to the limit of its solubility in the polymeric binder. A particularly preferred weight range for the electron donor in the coating composition is from about 10 weight percent to about 40 weight percent on a dry basis.

In general it is desirable to include a binder in the compositions of the invention. Materials which are employed as binders are film-forming polymeric materials having a fairly high dielectric strength and good electrically insulating properties. Such binders include styrene-butadiene copolymers; polyvinyl toluene-styrene copolymers; styrene-alkyd resins; silicone-alkyd resins; soya-alkyd resins; vinylidene chloride-vinyl chloride copolymers; poly(vinylidene chloride); vinylidene chloride-acrylonitrile copolymers; vinyl acetate-vinyl chloride copolymers; poly(vinyl acetals), such as poly(vinyl butyral); nitrated polystyrene; polymethylstyrene, isobutylene polymers; polyesters, such as poly-[ethylene-co-alkylenebis(alkyleneoxyaryl)-phenylenedicarboxylate]; phenolformaldehyde resins; ketone resins; polyamides; polycarbonates; polythiocarbonates; poly[ethylene-co-isopropylidene-2,2-bis(ethyleneoxyphenylene)terephthalate]; copolymers of vinyl haloarylates and vinyl acetate such as poly(vinyl-m-bromobenzoate-co-vinyl acetate) and chlorinated poly(olefins), such as chlorinated poly(ethylene). Other types of binders which are useful include such materials as paraffin, mineral waxes, etc. Combinations of binder materials are also useful.

Useful results are obtained by using the selected electron acceptors in combined amounts of about 0.001 to about 30 percent by weight of the photoconductive coating composition. The relative amounts of each electron acceptor used is unimportant so long as the combination is sensitizing. However, in some cases amounts outside of the ranges will be useful. The upper limit in the sensitizing amount of the combination of the electron acceptors present in a sensitized layer is determined as a matter of choice and the total amount of any electron acceptor used varies widely depending on, among other considerations, the electron acceptors selected, the electrophotographic response desired, the proposed structure of the photoconductive element and the mechanical properties desired in the element.

Suitable support materials for forming elements comprising layers of the photoconductive compositions of this invention include any of a wide variety of electrically conducting supports, such as paper (at a relative humidity of about 20 percent); aluminum-paper laminates; metal foils, such as aluminum, copper, zinc, brass and galvanized plates; vapor-deposited metal layers, such as silver, chromium, nickel, aluminum, cermet materials and the like coated on paper or conventional photographic film bases, such as cellulose acetate or polystyrene. Such conducting materials as nickel are vacuum deposited on transparent film supports in sufficiently thin layers to allow electrophotographic elements prepared therewith to be exposed from either side of such elements. An especially useful conducting support is prepared by coating a support material, such as poly(ethylene terephthalate) with a conducting layer containing a semiconductor dispersed in a resin. Such conducting layers both with and without insulating barrier layers are described in U.S. Pat. Nos. 3,245,833 and 3,880,657. Likewise, a suitable conducting coating is prepared from the sodium salt of a carboxyester lactone of maleic anhydride and a vinyl acetate polymer. Such conducting layers and methods for their optimum preparation and use are disclosed in U.S. Pat. Nos. 3,007,901 and 3,262,807.

The photoconductive compositions of this invention are optionally coated directly on a conducting substrate. In some cases, it is desirable to use one or more intermediate subbing layers between the conducting substrate and coating to improve adhesion of the coating to the conducting substrate and/or to act as an electrical barrier layer between the coated composition and the conducting substrate. Such subbing layers, if used, generally have a dry thickness in the range of about 0.1 to about 5 microns. Subbing layer materials which are used are described, for example, in U.S. Pat. Nos. 3,143,421; 3,640,708 and 3,501,301.

Overcoat layers are useful in the present invention, if desired. For example, to improve surface hardness and resistance to abrasion, the coated layer of the element of the invention is overcoated with one or more electrically insulating, organic polymer coatings or electrically insulating, inorganic coatings. A number of such coatings are well known in the art and accordingly extended discussion thereof is unnecessary. Useful such overcoats are disclosed, for example, in *Research Disclosure,* "Electrophotographic Elements, Materials, and Processes," Volume 109, page 63, Paragraph V, May, 1973, which is incorporated herein by reference.

Coating thicknesses of the photoconductive composition on the support vary widely. Generally, a coating in the range of about 0.5 micron to about 300 microns before drying is useful for the practice of this invention. The preferred range of coating thickness is found to be in the range from about 1.0 micron to about 150 microns before drying, although useful results can be obtained outside of this range. The resultant dry thickness of the coating is preferably between about 2 microns and about 50 microns, although useful results are obtained with a dry coating thickness between about 1 and about 200 microns.

The elements of the present invention are employed in any of the well-known electrophotographic processes which require photoconductive layers. One such process is the xerographic process. In a process of this type, a photoconductive element is held in the dark and given a blanket electrostatic positive or negative charge by treating it with a corona discharge. This uniform charge is retained by the layer because of the substantial dark insulating property of the layer, i.e., the low electrical conductivity of the layer in the dark. The electrostatic charge formed on the surface of the photoconductive layer is then selectively dissipated from the surface of the layer by imagewise exposure to UV, visible or infrared radiation. Front surface exposure, rear surface exposure in the case of a transparent electrode and contact-printing projection of an image are among the specific exposure techniques by which a latent electrostatic image is formed in the photoconductive layer.

The latent electrostatic image produced by exposure is developed or transferred to another surface and developed there, i.e., either the charged or uncharged areas are rendered visible, by treatment with a medium comprising electrostatically responsive particles having optical density (electroscopic toners). The developing electrostatically responsive particles are in the form of dust, i.e., powder, or a pigment in a resinous carrier, i.e., toner.

Liquid development of the latent electrostatic image formed on the elements of this invention is preferred. In liquid development, the developing particles (electroscopic toners) are carried to the image-bearing surface in an electrically insulating liquid carrier. Methods of development of this type are widely known and have been described in the patent literature, for example, Metcalfe et al, U.S. Pat. No. 2,907,674 issued Oct. 6, 1959.

The following examples are presented to further illustrate the invention.

FILM PREPARATION AND MEASUREMENTS

Film samples were prepared by first dissolving desired quantities of the two electron acceptors and tri-p-tolylamine in a halogenated solvent such as dichloromethane. To the above solution was added a specific amount of a stock solution containing the binder Lexan 145 (bisphenyl polycarbonate available from General Electric) in dichloromethane. After several minutes of mixing, the solution was coated onto Nickel-subbed poly(ethylene terephthalate) at 150μ wet thickness and dried overnight in an oven at 60° C.

Dried samples were then charged to some maximum potential ($E_o$) by means of a corona supplied by a Universal Voltronics high voltage supply and discharged with radiation at the wavelength maximum of the film from a Bausch & Lomb monochromater. Film potential was detected with a Monroe Electronics Electrostatic Voltmeter and recorded with a Hewlett Packard chart recorder. Light intensity was measured with an Optronics Laboratories, Inc. Model 730A radiometer. Film thickness was determined using a Peacock Upright Dial Gauge Type R1.

Films were allowed to discharge while exposed to the indicated radiation. The initial quantum efficiency (the number of electron-hole pairs produced per incident photon) at field strength $E_o$ was then determined by computation of the slope of the discharge curve at $E_o$. The photodischarge sensitivity at wavelength of irradiation ($S_{1/2}$), was also determined by allowing the films to discharge from $E_o$ to $E_o/2$. The amount of radiation necessary to produce this discharge was then calculated from the time required for this half-decay and the incident photon flux.

In Table II the initial quantum efficiencies, $\Phi_o$ and photosensitivities for hole generation of films containing (1) the first electron acceptor with the electron donor and (2) films containing the first electron acceptor, the electron donor and the second acceptor are compared. The comparisons are made at the wavelengths for maximum light absorption ($\lambda_{max}$) indicated under each first electron acceptor. Except for Example 14, the data of Table II shows that in general the quantum efficiency and the photosensitivity of films containing both acceptors increased compared to a film containing only the first acceptor at a wavelength at which the second acceptor does not absorb. This is unusual since one would not expect any enhancement in film performance at these wavelengths. This enhancement is shown to be synergistic. The evidence also shows that slight change in the donor or relative concentrations of the components would result in the combination of components in Example 14 showing increased quantum efficiency.

In Table II the numbers in parentheses under the molecular structures in Column 1 refer to $\lambda_{max}$ in nm of film without the second electron acceptor followed by $\lambda_{max}$ of film with the second electron acceptor. The second electron acceptor in Examples 1 to 12 was Compound 1 of Table I for which $\lambda_{max}$ is 365 nm. In Examples 13 and 14, the second electron acceptor was Compound 2 of Table I for which $\lambda_{max}$ is 360.

Columns 2 and 4 disclose the quantum efficiency and photosensitivity of films containing 31 percent tri-p-tolylamine and 2 percent of the first electron acceptor (except Example 10 which contains 1 percent of the first electron acceptor).

Columns 3 and 5 disclose the quantum efficiency and photosensitivity of films containing 28 percent tri-p-tolylamine, 9 percent of the second electron acceptor and 2 percent of the first electron acceptor (except Example 11 which contains only 1 percent of the first electron acceptor).

TABLE II

Quantum Efficiencies and Photosensitivities for Lexan Films Containing Boron Diketonate Dyes Positive charging, front surface exposure, $E_o = 1.5 \times 10^6$ v/cm

| Example No. | (1) First Electron Acceptor | (2) $\phi_o$ Without Second Acceptor | (3) $\phi_o$ With Second Acceptor | (4) Photosensitivity Without Second Acceptor $E_o \rightarrow E_o/2$ (ergs/cm$^2$) | (5) Photosensitivity With Second Acceptor $E_o \rightarrow E_o/2$ (ergs/cm$^2$) |
|---|---|---|---|---|---|
| 1 | 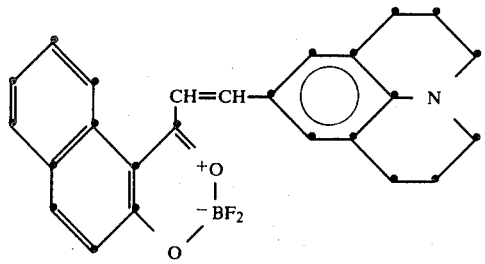 (605, 615) | 0.128 | 0.168 | 80 | 53 |
| 2 | 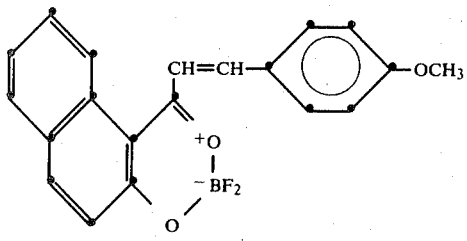 (470, 480) | 0.163 | 0.196 | 75 | 53 |

TABLE II-continued

Quantum Efficiencies and Photosensitivities for Lexan Films Containing Boron Diketonate Dyes
Positive charging, front surface exposure, $E_o = 1.5 \times 10^6$ v/cm

| Example No. | (1) First Electron Acceptor | (2) $\phi_o$ Without Second Acceptor | (3) $\phi_o$ With Second Acceptor | (4) Photosensitivity Without Second Acceptor $E_o \rightarrow E_o/2$ (ergs/cm$^2$) | (5) Photosensitivity With Second Acceptor $E_o \rightarrow E_o/2$ (ergs/cm$^2$) |
|---|---|---|---|---|---|
| 3 | 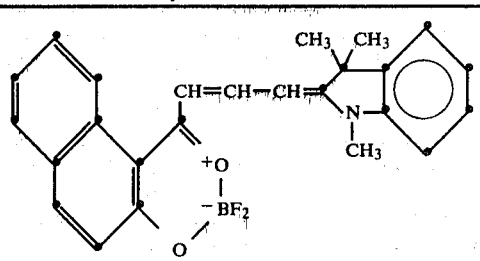 (580, 585) | 0.160 | 0.248 | 56 | 27 |
| 4 | 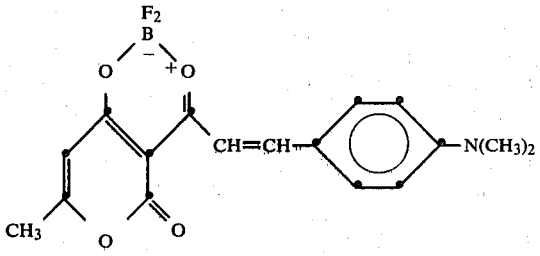 (555, 565) | 0.105 | 0.136 | 87 | 36 |
| 5 | 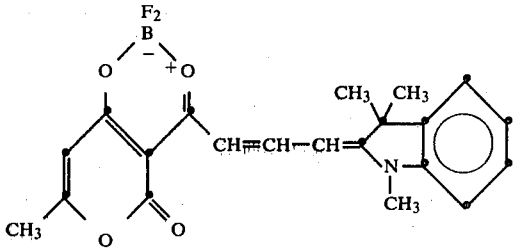 (560, 560) | 0.159 | 0.185 | 52 | 26 |
| 6 | 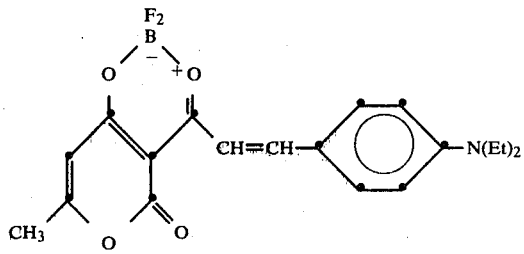 (570, 575) | 0.115 | 0.229 | 67 | 27 |
| 7 | 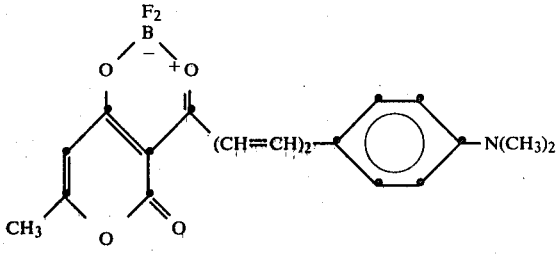 (615, 630) | 0.014 | 0.043 | 658 | 145 |

TABLE II-continued

Quantum Efficiencies and Photosensitivities for Lexan Films Containing Boron Diketonate Dyes Positive charging, front surface exposure, $E_o = 1.5 \times 10^6$ v/cm

| Example No. | (1) First Electron Acceptor | (2) $\phi_o$ Without Second Acceptor | (3) $\phi_o$ With Second Acceptor | (4) Photosensitivity Without Second Acceptor $E_o \rightarrow E_o/2$ (ergs/cm$^2$) | (5) Photosensitivity With Second Acceptor $E_o \rightarrow E_o/2$ (ergs/cm$^2$) |
|---|---|---|---|---|---|
| 8 | 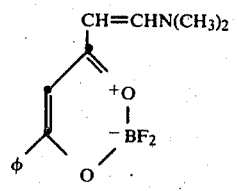 (410, 410) | 0.247 | 0.331 | 37 | 24 |
| 9 | 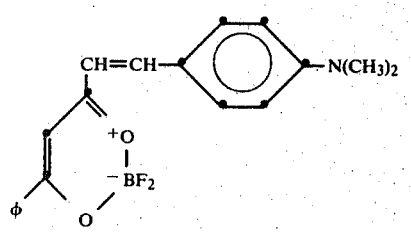 (540, 545) | 0.093 | 0.183 | 111 | 36 |
| 10 | 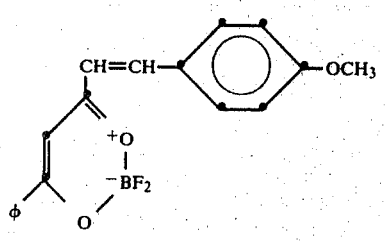 (430, 450) | 0.042 | 0.085 | 380 | 135 |
| 11 | 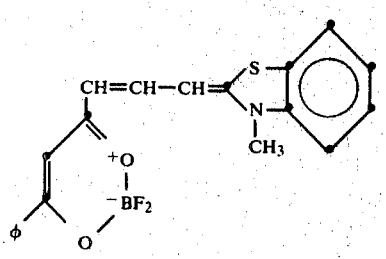 (580, 590) | 0.013 | 0.043 | 2000 | 423 |
| 12 | 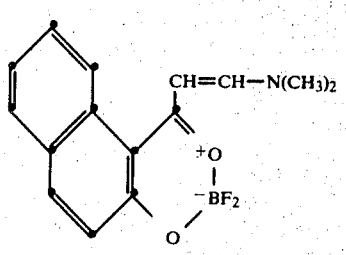 (420, 420) | 0.258 | 0.316 | 33 | 28 |

TABLE II-continued

Quantum Efficiencies and Photosensitivities for Lexan Films Containing Boron Diketonate Dyes
Positive charging, front surface exposure, $E_o = 1.5 \times 10^6$ v/cm

| Example No. | (1) First Electron Acceptor | (2) $\phi_o$ Without Second Acceptor | (3) $\phi_o$ With Second Acceptor | (4) Photosensitivity Without Second Acceptor $E_o \rightarrow E_o/2$ (ergs/cm$^2$) | (5) Photosensitivity With Second Acceptor $E_o \rightarrow E_o/2$ (ergs/cm$^2$) |
|---|---|---|---|---|---|
| 13 | 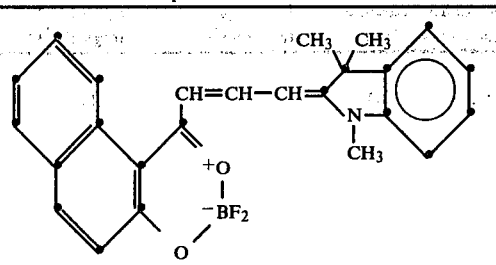 (580) | 0.160 | 0.178 | 56 | 30 |
| 14 | 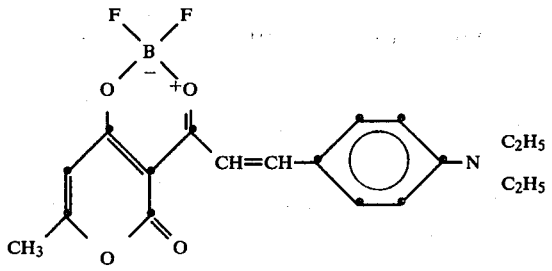 (570) | 0.115 | 0.104 | 67 | 38 |

The invention has been described in detail with particular reference to certain preferred embodiments thereof, but it will be understood that variations and modifications can be effected within the spirit and scope of the invention.

We claim:

1. A photoconductive element comprising a support and a layer of a photoconductor composition comprising:
   (a) an electron donating photoconductor; and sensitizing amounts of
   (b) a first electron acceptor selected from cyanine and styryl methine dyes having a 1,3,2-dioxaborin nucleus and
   (c) a second electron acceptor selected from methine-free compounds having a nucleus selected from the group consisting of 1,3,2-dioxaborin; 1,3,2-oxazoborin and 1,3,2-diazoborins.

2. A photoconductive element comprising a support and a photoconductor composition comprising:
   (a) an electron donor comprising a triarylamine component and sensitizing amounts of
   (b) a first electron acceptor having a structure selected from the group consisting of:

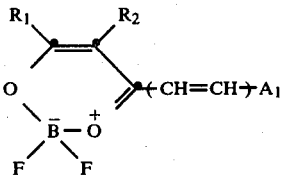

and

-continued

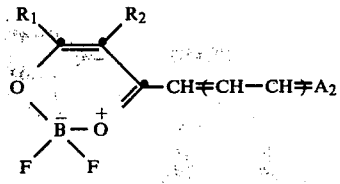

wherein:

$R_1$ and $R_2$ each independently represents hydrogen, alkyl, aryl or taken together with the carbon atom to which they are attached form a fused mono- or polynuclear carbocyclic group having 6 to 10 carbon atoms or a fused heterocyclic group selected from pyran-4-one, thiopyran-4-one, thiophene and furane;

$A_1$ represents substituted aminoaryl, alkylamino, julolylidine or aryl;

$A_2$ represents a nitrogen-containing heterocyclic nucleus;

(c) a second electron acceptor selected from the group consisting of:

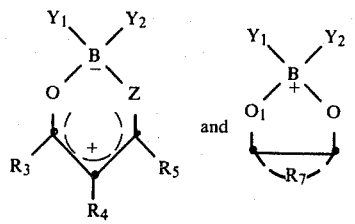

wherein:

$R_3$, $R_4$ and $R_5$ each independently represents hydrogen, hydroxy, alkyl, aryl, furyl, alkoxy, thienyl or trihaloalkyl, or $R_3$ and $R_4$ or $R_4$ and $R_5$, taken together with the carbon atoms to which they are attached represent fused thiopyran, or a mono- or polynuclear carbocyclic group having 6 to 10 carbon atoms;

$R_7$ represents the atoms necessary to form a member selected from the group consisting of pyran, thiopyran and benzopyran;

$Y_1$ and $Y_2$ represent fluoro or $Y_1$ and $Y_2$ taken together with B form a 1,3,2-dioxaborin nucleus;

Z represents O, and

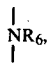

wherein $R_6$ represents aryl or $R_6$ together with

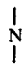

represents a fused benzothiazolene nucleus.

3. An element as in claim 2 wherein $R_1$ and $R_2$ each independently represents hydrogen, phenyl, furyl, thienyl, trifluoromethyl, or taken together with the carbon atoms to which they are attached form a fused nucleus selected from the group consisting of naphthyl, pyranone, benzothiazole, tropylium, thiopyrylium and flavylium;

$A_1$ represents a nucleus selected from the group consisting of julolidine, phenyl, phenylmethoxycarbonylamino, methoxyphenyl, dimethylaminophenyl, diethylaminophenyl and dimethylamino;

$A_2$ represents a nucleus selected from the group consisting of benzoazole and benzothiazole;

$R_3$, $R_4$ and $R_5$ each independently represents methyl, methoxy, phenyl, hydroxyphenyl, ethylphenyl, methylphenyl, nitrophenyl, dimethylaminophenyl, cyanophenyl, methoxyphenyl, furyl, thienyl or trifluoromethyl; or $R_3$ and $R_4$ or $R_4$ and $R_5$, taken together with the carbon atom to which they are attached, form a fused substituent selected from the group consisting of phenyl, naphthyl and hydroxy naphthyl;

$Y_1$ and $Y_2$ represent fluro or taken together form a dioxaborin nucleus.

4. A photoconductive element comprising a support and a photoconductor composition comprising:

(a) tri-p-tolylamine as the electron donor and a sensitizing amount of (b) as a first electron acceptor a dye selected from the group of dyes disclosed in Table II herein, and (c) as a second electron acceptor a compound selected from the group consisting of (1,3-diphenyl-1,3-propanedioato-0,0')difluoroboron and (1-trifluoromethyl-3-phenyl-1,3-propanedioato-0,0')difluoroboron.

5. A method of enhancing the quantum efficiency of electron donating photoconductive compositions comprising the step of adding a sensitizing amount of an electron accepting sensitizer characterized in that the sensitizer is a combination of (a) a first electron acceptor selected from cyanine and styryl methine dyes having a 1,3,2-dioxaborin nucleus and (b) a second electron acceptor selected from methine-free compounds having a nucleus selected from the group consisting of 1,3,2-dioxaborin; 1,3,2-oxazoborin and 1,3,2-diazoborins.

* * * * *

UNITED STATES PATENT AND TRADEMARK OFFICE

CERTIFICATE OF CORRECTION

PATENT NO. : 4,394,428

DATED : July 19, 1983

INVENTOR(S) : J. VanAllan, J. Perlstein, G. Reynolds & T. Goliber

It is certified that error appears in the above-identified patent and that said Letters Patent is hereby corrected as shown below:

Title page, the part of the title reading "NUCLEAS ON A" should read --NUCLEUS OR A--.

Col. 1, line 5, the part of the title reading "NUCLEAS ON A" should read --NUCLEUS OR A--.

Signed and Sealed this

*Fourth* Day of *October 1983*

[SEAL]

*Attest:*

GERALD J. MOSSINGHOFF

*Attesting Officer*

*Commissioner of Patents and Trademarks*